US012281416B2

(12) United States Patent
Peuker et al.

(10) Patent No.: US 12,281,416 B2
(45) Date of Patent: Apr. 22, 2025

(54) SPINNING STATION OF AN AIR-JET SPINNING MACHINE AND METHOD FOR CARRYING OUT A PIECING PROCESS AT SUCH A SPINNING STATION

(71) Applicant: Saurer Intelligent Technology AG, Arbon (CH)

(72) Inventors: Heinz-Josef Peuker, Wegberg (DE); Martin Reszat, Lünen (DE); Dirk Schiffers, Korschenbroich (DE); Sarah Meissner, Geilenkirchen (DE)

(73) Assignee: Saurer Intelligent Technology AG, Arbon (CH)

( * ) Notice: Subject to any disclaimer, the term of this patent is extended or adjusted under 35 U.S.C. 154(b) by 0 days.

(21) Appl. No.: 18/538,768

(22) Filed: Dec. 13, 2023

(65) Prior Publication Data

US 2024/0209550 A1 Jun. 27, 2024

(30) Foreign Application Priority Data

Dec. 22, 2022 (LU) ..... 503239

(51) Int. Cl.
*D01H 4/48* (2006.01)
*D01H 1/115* (2006.01)
(Continued)

(52) U.S. Cl.
CPC ..... *D01H 4/48* (2013.01); *D01H 1/115* (2013.01); *D01H 4/02* (2013.01); *D01H 4/42* (2013.01); *D01H 5/32* (2013.01)

(58) Field of Classification Search
CPC .. D01H 4/02; D01H 4/42; D01H 4/48; D01H 1/003; D01H 1/115; D01H 5/22; D01H 5/32
See application file for complete search history.

(56) References Cited

U.S. PATENT DOCUMENTS 4,545,193 A * 10/1985 Tanaka ..... D01H 15/002 57/22
5,704,204 A * 1/1998 Mima ..... D01H 15/002 57/328
(Continued)

FOREIGN PATENT DOCUMENTS

DE 10102379 A1 7/2002
DE 102004050968 A1 * 4/2006 ..... D01H 1/115
(Continued)

OTHER PUBLICATIONS

Search Report issued in corresponding Luxembourg Application No. LU 503239, dated Jul. 3, 2023 (8 pages).
(Continued)

*Primary Examiner* — Shaun R Hurley
(74) *Attorney, Agent, or Firm* — FLYNN THIEL, P.C.

(57) ABSTRACT

A spinning station of a spinning machine for producing a thread from a sliver. A thread end is taken up by a take-up device and transferred to a preparation device downstream from a vortex chamber of the spinning device, the thread end is subsequently treated in the preparation device and then transferred to the vortex chamber, a drafting system for supplying a sliver to the vortex chamber is powered up, wherein an exit roller pair of the drafting system is accelerated to a predetermined draw-off speed, and the sliver is spun onto the thread end in the vortex chamber and a draw-off device for drawing off the thread spun in the vortex chamber is powered up and accelerated up to the draw-off speed. The speed of the exit roller pair and/or of the draw-off device increases non-linearly and/or approaches the predetermined draw-off speed non-linearly around the end of powering up.

10 Claims, 5 Drawing Sheets

(51) Int. Cl.

| | |
|---|---|
| ***D01H 4/02*** | (2006.01) |
| ***D01H 4/42*** | (2006.01) |
| ***D01H 5/32*** | (2006.01) |

(56) References Cited

U.S. PATENT DOCUMENTS

| | | | | |
|---|---|---|---|---|
| 5,809,764 | A * | 9/1998 | Baba | D01H 1/115 57/263 |
| 6,691,501 | B2 | 2/2004 | Anderegg et al. | |
| 6,792,744 | B2 | 9/2004 | Feuerlohn et al. | |
| 6,959,532 | B2 * | 11/2005 | Wust | D01H 15/002 57/22 |
| 7,464,530 | B2 * | 12/2008 | Stahlecker | D01H 1/115 57/263 |
| 11,753,747 | B2 | 9/2023 | Mohr et al. | |
| 2002/0124545 | A1 * | 9/2002 | Griesshammer | D01H 5/005 57/317 |
| 2002/0144496 | A1 * | 10/2002 | Anderegg | D01H 15/002 57/261 |

FOREIGN PATENT DOCUMENTS

| | | | | |
|---|---|---|---|---|
| EP | 1219737 | A1 | 7/2002 | |
| EP | 1329542 | A2 | 7/2003 | |
| EP | 1347085 | A2 * | 9/2003 | D01H 1/115 |
| EP | 1347085 | B2 * | 4/2010 | D01H 1/115 |
| EP | 3330416 | A1 | 6/2018 | |
| WO | 2019/012143 | A2 | 1/2019 | |

OTHER PUBLICATIONS

Search Report issued in corresponding European Application No. 23217637.0, with English translation of category of cited documents, dated May 6, 2024 (8 pages).
U.S. Appl. No. 18/521,159.

* cited by examiner

SPINNING STATION OF AN AIR-JET SPINNING MACHINE AND METHOD FOR CARRYING OUT A PIECING PROCESS AT SUCH A SPINNING STATION

The invention relates to a spinning station of an air-jet spinning machine for producing a thread from a sliver, and to a method for carrying out a piecing process in such a spinning station with an air-jet spinning device, wherein:

- a thread end that has run onto a take-up bobbin is taken up by means of a thread take-up device and transferred to a thread-end preparation device downstream from a vortex chamber of the air-jet spinning device in the thread running direction,
- the thread end is subsequently treated in the thread-end preparation device and then transferred to the vortex chamber of the air-jet spinning device and positioned there,
- a drafting system for drafting and supplying a sliver to the vortex chamber is powered up, wherein an exit roller pair of the drafting system is accelerated up to a predetermined draw-off speed, and wherein the sliver is spun onto the prepared thread end in the vortex chamber,
- a motor-driven draw-off device for drawing off the thread spun in the vortex chamber is powered up and thereby accelerated up to the draw-off speed.

Generic spinning stations of the type mentioned at the outset and methods for carrying out a piecing process after an interruption of spinning are known in various embodiments from the prior art. In the course of the spinning process, defects repeatedly occur in which thread sections arise whose parameters such as the thread thickness, the hairiness, the thread strength, etc. deviate from a predetermined setpoint. Such thread defects are detected by a thread sensor and must be removed in a cleaner cut interrupting the spinning process. Likewise, during the spinning process, thread breaks occur in which the thread tears, which also necessitates re-attachment of the thread end to the sliver supplied to the air-jet spinning machine in the vortex chamber.

To carry out the piecing process, it is necessary to take up the particular thread end that has run onto a take-up bobbin from the take-up bobbin with the aid of a spinning station's thread take-up device or one that can be moved past the spinning station, in particular one that is arranged to be movable on the air-jet spinning machine, in order to transfer it to the vortex chamber of the air-jet spinning device against the actual sliver running direction during the spinning process, in order to connect it there to the sliver supplied through the drafting system.

To prepare the thread end for connection to the supplied sliver, it is necessary to prepare the thread end before piecing for connection to the sliver. A thread-end preparation device is used for this purpose which is arranged downstream from the vortex chamber in the thread running direction and serves to cut the thread end to a predefined length and unravel the thread end, i.e. undo its existing twist so that it can be connected to the supplied sliver. After the thread end has been unraveled, it is transported to the vortex chamber and held there, for example by means of blown air, with the release of a clamp that positions the thread end in the thread-end preparation device.

In the piecing process which then takes place, the sliver is supplied to the vortex chamber via the exit roller pair of the drafting system, and is connected to the free thread end placed there, forming a thread in the vortex chamber, and is then drawn off from the vortex chamber via the draw-off device. Drafting system roller pairs and/or apron roller pairs upstream from the exit roller pair rotate during the spinning process at a respective final speed due to the system, which is below the draw-off speed of the exit roller pair, in order to effect drafting of the sliver in the drafting system.

At the beginning of the piecing process, the drafting system is first powered up and only afterward is the draw-off device started so that at the beginning of the piecing process, there is a dwell time for the thread end in the vortex chamber during which the sliver supplied via the exit rollers of the drafting system is connected to the thread end in the vortex chamber. After this dwell time has elapsed, both the draw-off device and the exit roller pair of the drafting system are accelerated up to a predetermined draw-off speed at which the spinning process is then continued. At present, the increase in the speed of the draw-off device and the supplying draw-off roller pair of the drafting system is linear up to the draw-off speed predetermined during regular spinning operation, as is the speed increase of additional drafting system roller pairs and/or apron roller pairs of the drafting system, so that there are particularly high acceleration values at the beginning of powering up. In addition to a high material load, this also leads to a sudden increase in the fiber mass in the vortex chamber, which can lead to drafting or accumulation of the fibers and thus to a poor thread connection.

Proceeding from this, the object of the invention is to provide a method for carrying out a piecing process and an air-jet spinning machine which allow a reliable piecing process.

Characteristic of the method according to the invention for carrying out the piecing process is that the exit roller pair and/or the draw-off device are powered up in such a way that the speed of the exit roller pair and/or of the draw-off device increases non-linearly at the beginning of powering up and/or approaches the predetermined draw-off speed non-linearly around the end of powering up. A non-linear curve of the speed increase both at the beginning of the piecing process, in which the exit roller pair of the drafting system and any additional or available drafting system roller pairs and/or apron roller pairs as well as the draw-off device are powered up from standstill, as well as during the transition from the acceleration process to a constant draw-off speed at the end of the piecing process, is understood to mean a speed curve that extends arcuately in a speed-time diagram, i.e. the speed does not increase or decrease evenly over time. For example, the curve can increase exponentially at the beginning of the piecing process and approach the predetermined draw-off speed exponentially at the end of the piecing process.

A non-linear curve of the speed increase of the draw-off roller pair of the drafting system at the beginning of the piecing process leads to a moderate and uniform fiber introduction into the vortex chamber, so that the fiber mass within the vortex chamber does not increase suddenly, but rather slowly. In addition, the method according to the invention avoids sudden acceleration processes that put a strain on the components of the spinning station, so that the employed components have a long service life. The method according to the invention also ensures a particularly high thread quality, in particular at the beginning of the piecing process.

The curve of the speed increase in the range between the non-linear curve can in principle be configured in any desired manner. According to a particularly advantageous embodiment of the invention, however, it is provided that the exit roller pair and/or the draw-off device are powered up in such a way that their speed is linear in the range between the non-linear start of powering up and/or the non-linear approach to the draw-off speed around the end of powering up. This embodiment of the invention ensures that, after a moderate start to the piecing process and/or its completion, the piecing process is carried out quickly with a subsequent transition to the spinning process at a constant production speed. Powering up the draw-off device and/or the exit roller pair is understood to mean the startup of the drafting system and the draw-off device, within which they are accelerated from standstill to the draw-off speed.

During the production process, the exit roller pair and the draw-off device have a matching production speed, referred to as the draw-off speed. As a result of the system, the drafting system roller pairs and/or apron roller pairs upstream from the exit roller pair in the thread running direction have a lower production speed in order to achieve the desired drafting of the sliver within the drafting system. According to an advantageous embodiment of the invention, it is provided that drafting system roller pairs and/or apron roller pairs of the drafting system arranged upstream from the exit roller pair in the thread running direction are powered up in such a way that their speed increases non-linearly at the beginning of powering up and/or approaches a respective final speed associated with the draw-off speed non-linearly around the end of powering up. This embodiment of the invention avoids sudden accelerations in the entire drafting system, which can lead to damage to the components of the drafting system, in a particularly reliable manner. This development of the invention according to the invention thus increases the service life of the drafting system in a supplementary manner and also ensures particularly reliably that the fibers supplied by the drafting system reach the vortex chamber in a particularly moderate manner at the beginning of the piecing process.

In order to ensure reliable piecing, i.e. a connection of the free thread end to the supplied sliver, according to a further development of the invention it is provided that, in order to establish a period of time defining a dwell time of the thread end in the vortex chamber, the drafting system is powered up in advance of the draw-off device. This embodiment yields a sufficiently long time period within which the sliver is connected to the free thread end in the vortex chamber, wherein the non-linear powering up prevents fiber jamming in the vortex chamber. The draw-off device starts after completion of a reliable connection of the sliver to the thread end, so that the thread can then be drawn off from the vortex chamber and wound onto the take-up bobbin.

According to a further embodiment of the invention, it is provided that the exit roller pair of the drafting system is powered up in advance of and decoupled from the additional drafting system roller pairs and/or apron roller pairs of the drafting system arranged upstream from the exit roller pair in the thread running direction. An advantage of this embodiment of the invention is that fluctuations when powering up the exit roller pair, as a result of which fibers are not conveyed at the speed predetermined by the rest of the drafting system and which can lead to additional drafting or accumulation of the fibers, are avoided.

Due to the fact that the exit roller pair of the drafting system can be operated independently of the additional drafting system roller pairs and/or apron roller pairs, it is also possible to drive only the exit roller pair while the drafting system and/or apron roller pairs of the drafting system are at a standstill. This embodiment of the invention therefore also makes it possible to comb out the sliver in the region of the sliver end, whereby the sliver end can be given defined properties which lead to an increase in the quality of the piecing. The output roller pair can be controlled via a control unit depending on the sliver and thread parameters.

The time at which the combing out process begins and the duration are generally freely selectable. According to a particularly advantageous embodiment of the invention, however, it is provided that during

- the take-up of the thread end that has run onto the take-up bobbin and its transfer to the thread-end preparation device and/or
- the preparation of the thread end in the thread-end preparation device and/or
- the transfer and positioning of the prepared thread end in the vortex chamber,
- the exit roller pair is operated at a predetermined combing out speed and the drafting system roller pairs and/or apron roller pairs arranged upstream from the exit roller pair in the thread running direction are stopped or operated at a holding speed associated with the combing out speed, which holding speed is a maximum of 10% of the combing out speed.

According to this embodiment of the invention, it is provided that the exit roller pair prepares the free end of the sliver arranged in the drafting system by a combing out process during a fixed period of the return process of the thread end that has run onto the take-up bobbin to the vortex chamber. The combing out process can be carried out in such a way that the additional drafting system roller pairs and/or apron roller pairs of the drafting system are at a standstill or are operated at only a low holding speed which is significantly below the combing out speed of the exit roller pair, so that a combing out process of the free end of the sliver can still be carried out, and it can be optimally prepared for the piecing process onto the free thread end arranged in the vortex chamber. Tracking the sliver by the additional drafting system roller pairs and/or apron roller pairs at a holding speed also allows the free sliver end to be prepared over a longer portion for the piecing process through the combing out process.

Characteristic of the spinning station according to the invention is that it has a control unit for a method for carrying out a piecing process at a spinning station of an air-jet spinning machine. The control unit is connected to the spinning station in such a way that it can set the parameters on the drafting system and the draw-off device required to carry out the inventive or further developed piecing process described above. The control unit can be integrated into a central air-jet spinning machine control unit or be provided separately at the spinning station and/or external to the spinning station, for example in a mobile or stationary device outside the air-jet spinning machine.

According to a particularly advantageous embodiment of the invention, the control unit is designed in particular to adjust the non-linear speed increase of the exit roller pair and/or the draw-off unit at the beginning of powering up and/or at the end of powering up. According to this development of the invention, the control unit enables variable settings of the range of the non-linear speed increase depending on the sliver to be processed. This can affect both the duration and the acceleration curve in the non-linear range of the speed increase.

According to a further embodiment of the invention, it is furthermore provided that the drafting system has a single-motor driven draw-off roller pair which can be controlled decoupled from additional drafting system roller pairs and/or apron roller pairs by means of the control unit. This embodiment of the invention makes it possible to comb out the sliver in the region of its free end via the draw-off roller pair and thereby to optimally prepare it for the piecing process, wherein, in the case of a driven draw-off roller pair, any drafting system roller pairs and/or apron roller pairs are then stationary or convey the sliver in the direction of the exit roller pairs with only a low holding speed.

The invention is explained in more detail below with reference to embodiments shown in the drawings. In the drawings.

Figure 1:
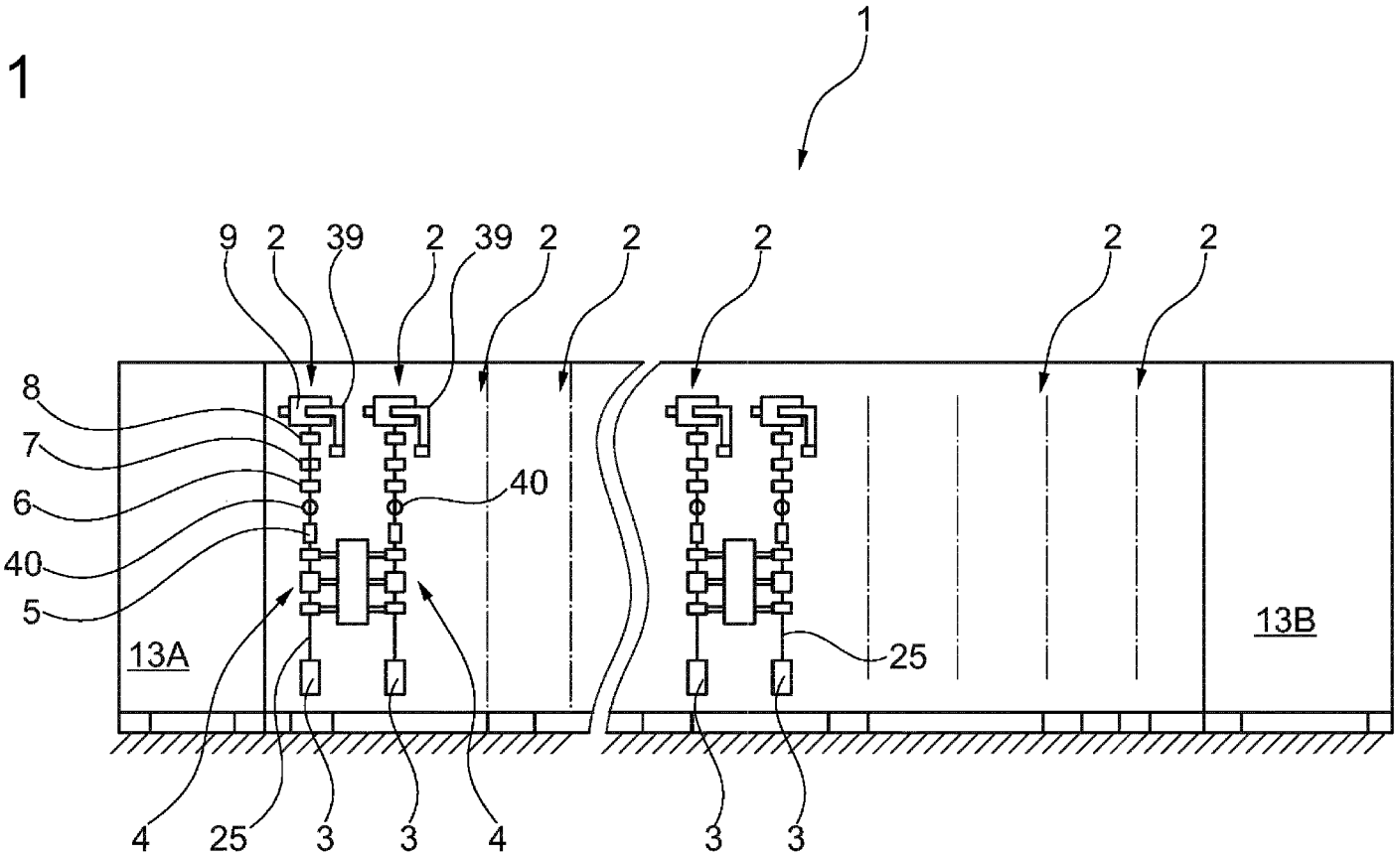
FIG. 1 shows a front view of an air-jet spinning machine with workstations, each having a workstation-specific thread take-up device and a thread-end preparation device for supplying its air-jet spinning device.

FIG. 1 schematically shows, in a front view, a textile machine, an air-jet spinning machine 1 in the present case, producing what is usually referred to as a cross-wound bobbin 9. Such textile machines 1 have a plurality of spinning stations 2 between machine frames 13A, 13B arranged at the end of the machine. A spinning can 3 is positioned at each of the spinning stations 2 and is equipped with a supply of feed material, for example with a sliver 25.

The spinning stations 2 furthermore each have a drafting system 4, an air-jet spinning device 5, a draw-off device 6, a thread cleaner 7 and a thread-checking device 8 which ensures that the thread 36 spun or produced from the sliver 25 in the air-jet spinning device 5 is wound in crossing layers onto a take-up bobbin 9. The so-called cross-wound bobbin 9 produced during the spinning process is in each case held in a bobbin frame (not shown), as is customary, and is rotated by a bobbin drive (also not shown).

Each of the spinning stations 2 is also equipped with a thread take-up device 39 which makes it possible to take up a thread end 37 of a produced thread 36 that has run onto the cross-wound bobbin 9 after an interruption of spinning and to transfer it to a so-called thread-end preparation device 40 arranged in the region of the draw-off device 6.

Figure 2:
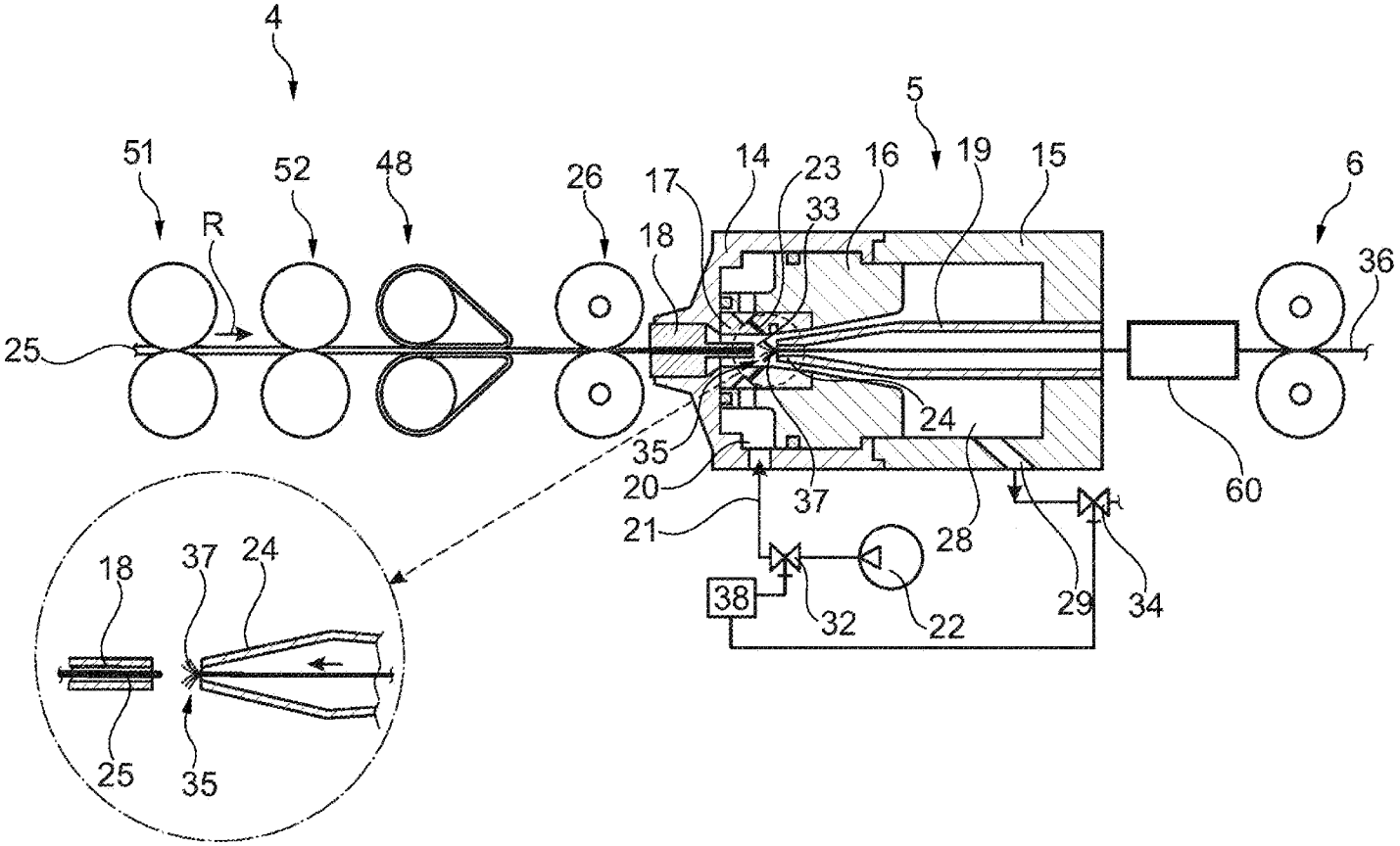
FIG. 2 shows a sectional view in a schematic representation of an air-jet spinning device during the piecing process.

FIG. 2 shows, in a side view and a larger scale, an air-jet spinning device 5 suitable for carrying out the method according to a preferred embodiment during the piecing process.

As can be seen, the drafting system 4 for drafting the sliver 25 is upstream from the air-jet spinning device 5 shown in section. Downstream from the air-jet spinning device 5 in the thread running direction R is a draw-off device 6 which can be driven reversibly by a single motor and ensures that the produced thread 36 can be conveyed in the direction of the take-up bobbin 9 and in the opposite direction thereto.

Figure 3:
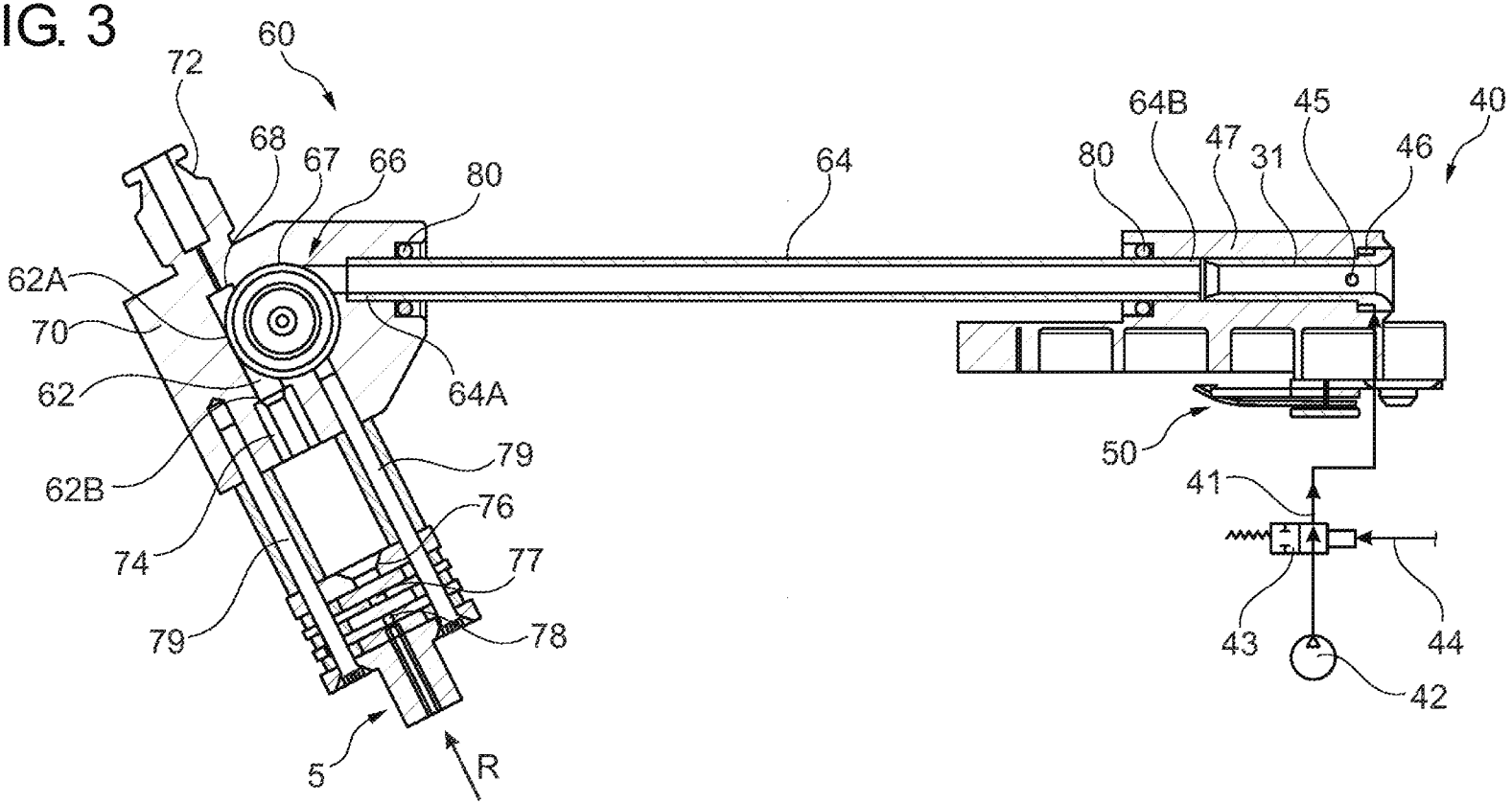
FIG. 3 shows a sectional view of a thread guide channel of an air-jet spinning machine shown in FIG. 1.

In addition, the thread-end preparation device 40 shown in FIG. 3 is arranged in the region of the thread draw-off device 6 which prepares the thread end 37 of the produced thread 36, which has been retrieved by the thread take-up device 39, for the subsequent piecing process.

As shown in FIG. 2, the air-jet spinning device 5 basically consists of a two-part outer housing 14, 15, an expansion housing 16, a nozzle block 17, a sliver guide 18 and a hollow spinning cone 19.

In this case, the expansion housing 16, in conjunction with the front housing part 14 of the outer housing, forms a front annular space 20 which is connected to an overpressure source 22 via a pneumatic line 21 and is connected to the expansion space 28 arranged in the rear housing part 15 of the outer housing.

While the expansion space 28 is indirectly connected to the ambient atmosphere via an exhaust air channel 29, the annular space 20 is pneumatically continuously connected to at least one blowing air nozzle 23 which are arranged in the nozzle block 17.

The blowing air nozzle 23 opens into a vortex chamber 33 in the region upstream from the inlet opening 35 of the spinning cone 19 and is thus directed onto the head 24 of the spinning cone 19 in such a way that a rotating air flow is created on the latter. The spinning cone 19 is preferably made of a highly wear-resistant material, for example a technical ceramic material.

To control the supply of compressed air, the pneumatic line 21 is equipped with a valve 32, the actuation of which preferably takes place by a spinning station's control unit 38 which is connected to the valve via corresponding control lines.

During the normal, previously known spinning process, which is not shown here, the sliver 25, which is stored in a spinning can 3, first passes through the drafting system 4 on its way to the cross-wound bobbin 9, where it is strongly drafted. Via the exit roller pair 26 of the drafting system 4, the sliver 25 stretched by a first and second drafting system roller pair 51, 52 and the apron roller pair 48 is then transferred to the region of the entrance opening of the air-jet spinning device 5 and sucked into the vortex chamber 33 of the air-jet spinning device 5 under the influence of a negative pressure flow present there. Inside the air-jet spinning device 5, the stretched sliver 25 passes via the sliver guide 18 and the nozzle block 17 to the inlet opening 35 of the hollow spinning cone 19 and is drawn into the spinning cone 19 by the thread 36 forming within the spinning cone 19. In so doing, the sliver 25 is exposed to the influence of a rotational flow in the region of the head 24 of the spinning cone 19 which is generated by the air flow exiting the nozzle block 17.

The valve 32 is open for the defined supply of this air flow to the nozzle block 17 initiated by the overpressure source 22. In order to enable the outflow of the air flow flowing in via the nozzle block 17 through the exhaust air duct 29 to the ambient atmosphere or to the machine's own suction during the spinning process, a valve 34 connected to the control unit 38 via a corresponding control line is open.

During the spinning process, due to the continuous movement of the sliver 25 in the thread running direction R, the sliver 25 is continuously drawn into the hollow spinning cone 19, wherein the edge fibers are wound helically around the core fibers of the sliver 25. The thread 36 produced thereby is pulled out of the air-jet spinning device 5 by means of the thread withdrawal device 6 and subsequently wound into a cross-wound bobbin 9.

If an interruption of spinning occurs during the spinning process, for example due to a breaking of the sliver 25 or due to a controlled cut of the already spun thread 36 by the thread cleaner 7, a piecing process must first be carried out before a restart of the spinning process.

As is known, to carry out a piecing process, on the one hand the stretched sliver 25 and on the other hand the already finished thread 36 which has run onto the cross-wound bobbin 9 are required.

After an interruption of spinning, the thread end 37 of the already finished thread 36 is first retrieved from the cross-wound bobbin 9 by the workstation's own thread take-up device 39 of the relevant workstation 2 and transferred to a thread-end preparation device 40 equipped with a holding and unraveling tube 31, preferably arranged downstream from the air-jet spinning device 5 in the thread running direction R, as shown by way of example in FIGS. 5 to 8. In the holding and unraveling tube 31, the thread end 37 is largely freed from twist and loose fibers.

As can be seen in FIG. 3, the thread-end preparation device 40 has a holding and unraveling tube 31 arranged in a take-up housing 47. The take-up housing 47 in turn has an annular space 46, to which a compressed air source 42 is connected via a pneumatic line 41. A valve 43 is inserted into the pneumatic line 41 and is connected via a control line 44, for example to the control unit 38 (not shown in FIG. 3) of the spinning station 2. The holding and unraveling tube 31 is equipped with at least one blow nozzle 45 which is connected to the annular space 46.

As is known per se, a thread must first be inserted into the holding and unraveling tube 31 in order to prepare its thread end for a thread connection process. This means that the thread 36 retrieved from a cross-wound bobbin 9 by a thread take-up device 39 is provided by the thread take-up device 39 to the thread-end preparation device 40 in such a way that it can be pneumatically threaded into the holding and unraveling tube 31. For this purpose, the thread-end preparation device 40 can interact with at least one cutting device 50 which cuts the retrieved thread 36 to length as required. During the cutting process, the valve 43 is actuated and compressed air is blown into the holding and unraveling tube 31 via the blowing nozzle 45 in order to pneumatically thread or suck the cut thread end 37 into the holding and unraveling tube 31. The threaded thread end 37 is freed of thread twist and loose fibers in the holding and unraveling tube 31. If necessary, a clamping device can also be provided which clamps the thread in a known manner before the cutting process. The clamping device can be combined with the cutting device in a further preferred manner.

As further shown in FIG. 3, the thread-end preparation device 40 is coupled to a thread guide channel 60 for guiding the thread 36, wherein the thread guide channel 60 is arranged directly adjacent to the thread-end preparation device 40 in the thread running direction R between the air-jet spinning device 5 and the thread-end preparation device 40. The thread running direction R is identical to the running direction of the thread in the spinning mode of the air-jet spinning machine 1, in which the thread 36 is spun by means of the air-jet spinning device 5.

The thread guide channel 60 according to the embodiment shown in FIG. 3 comprises a first channel portion 62 and a second channel portion 64 with the interposition of a channel connection portion 66. The first channel portion 62 and the channel connection portion 66 are accommodated by a housing 70. The housing 70 has a fastening portion (not shown) for fastening the thread guide channel 60 to a frame or housing of a workstation 2 of the air-jet spinning machine 1. A first end 64A of the second channel portion 64 ends in a sealing manner in the housing 70 with the interposition of an O-ring 80. A second end 64B of the second channel portion 64 ends in a sealing manner in the take-up housing 47 of the thread-end preparation device 40 with the interposition of an additional O-ring 80, wherein the second end 64B rests directly against the associated end of the holding and unraveling tube 31 and forms a common channel passage for the thread 36 or the thread end 37.

The channel connection portion 66 comprises a thread deflection portion 67 for deflecting the thread 36 between the first 62 and the second channel portion 64. The thread deflection portion 67 is designed in the manner of a circular arc in cross-section, wherein the end 64A of the second channel portion 64, which protrudes into the housing 70 and is connected to the channel connection portion 66, is coupled via the thread deflection section 67, which is circular arc-shaped in cross-section, to a first end 62A of the first channel portion 62, which is connected to the channel connection portion 66, for guiding the thread 36 between the air-jet spinning device 5 and the thread-end preparation device 40. The thread guide channel 60 thus forms a portion partially housing the thread running path. This also forms an angle of less than 180°, in the embodiment shown of less than 90°, between the first 62 and the second channel portion 64. The thread guide channel 60 can thereby be designed compactly. In this case, the fastening portion can be easily provided on a side of the thread guide channel 60 which faces away from the side enclosing the angle.

The housing 70 further comprises a receptacle for a compressed air connection 72, for example in the form of an injector, via which compressed air can be supplied via an opening 68 into the first channel portion 62 to generate pneumatic overpressure, wherein a suction effect is created simultaneously in the second channel portion 64. The opening 68 adjoins the first end 62A of the first channel portion 62 and supplies the compressed air parallel, in particular congruent, to a thread guide axis of the first channel portion 62 and transversely to a thread guide axis of the second channel portion 64. The thread guide axis is the axis along which the thread is guided in the thread guide channel 60 or in the corresponding channel portions 62, 64, 66.

The second end 62B of the first channel portion 62 adjoins a nozzle insert 74 that is accommodated in the housing 70 and can preferably be inserted and removed in a non-destructive manner. The thread end 37 guided with compressed air from the first channel portion 62 is blown via this nozzle insert 74 in the direction of a funnel inlet 76 which is at a distance opposite from the outlet of the nozzle insert 74. According to one embodiment, the distance between the outlet of the nozzle insert 74 and the funnel inlet 76 is unchangeable relative to one another and, according to a further embodiment, can in particular be variably adjusted, whereby a reduction in the intensity of the compressed air guiding the thread end 37 can be achieved. In other words, a portion of the compressed air guiding the thread end 37 can escape in the gap formed between the outlet of the nozzle insert 74 and the funnel inlet 76, while the remaining portion guides the thread end 37 into the funnel inlet 76. According to this embodiment, the funnel inlet 76 is followed in the direction of the air-jet spinning device 5 by two additional thread passages 77, 78, between which additional gaps are formed for the escape of a defined proportion of the compressed air before the thread end 37 can enter the air-jet spinning device 5 against the sliver or thread running direction R. The funnel inlet 76 with the intermediate thread passages 77, 78 is held between the housing 70 and the air-jet spinning device 5 by means of fastening screws 79. The air-jet spinning device 5 and the housing 70 are coupled to one another by means of the fastening screws 79. In particular, according to a further embodiment, a position of the funnel inlet 76 and/or of the intermediate thread passages 77, 78 along the fastening screws 79 can be variably adjusted as required in order to be able to adjust the proportion of escaping compressed air in the individual portions. By means of the arrangement, the thread or the prepared thread end 37 can be guided in a gentle manner to the air-jet spinning device 5. The thread end 37 prepared as above and transferred to the air-jet spinning device 5 is then connected to the sliver 25 provided by the drafting system 4.

The supply of the prepared thread end 37 ends when the prepared thread end 37, as shown in FIG. 2, is positioned somewhat spaced in front of the inlet opening 35 of the spinning cone 19 within the vortex chamber 33 of the air-jet spinning device 5. In order to ensure that the thread end 37 is always positioned correctly, the thread draw-off device 6 is driven by a single motor, for example via a stepper motor, wherein the stepper motor is controlled in such a way that by detecting the number of steps of the stepper motor, the thread draw-off device 6 is driven reversibly, i.e. against the thread draw-off direction prevailing in the spinning operation, in order to be able to effect a defined, needs-based return of the thread end 37 accompanied by the air flow prevailing in the thread guide channel 60 along the direction pointing from the thread draw-off device 6 to the air-jet spinning device 5 up to the predetermined position. Preferably, a sensor connected to the control unit 38 can be provided in the region of the nozzle block 17 and the inlet opening 35 of the spinning cone 19, by means of which the correct positioning of the thread end 37 can also be confirmed.

As soon as the thread end 37 has reached its predetermined position, the control unit 38 causes a switchover of the valves 32 and 34 so that the nozzle block 17 is again supplied with compressed air. At the same time, the drafting system 4, which is also driven by a single motor, and the thread draw-off device 6 are controlled in such a way that a free end of the sliver 25 first comes into contact with the prepared thread end 37 of the thread 36, the sliver 25 is vortexed with the prepared thread end 37 of the thread 36, and these are connected to one another in such a way that a new thread that can be drawn off is created, which can be drawn off in a defined manner from the air-jet spinning device 5 by means of the thread draw-off device 6. The piecing process accordingly transitions into the normal spinning process.

Figure 4:
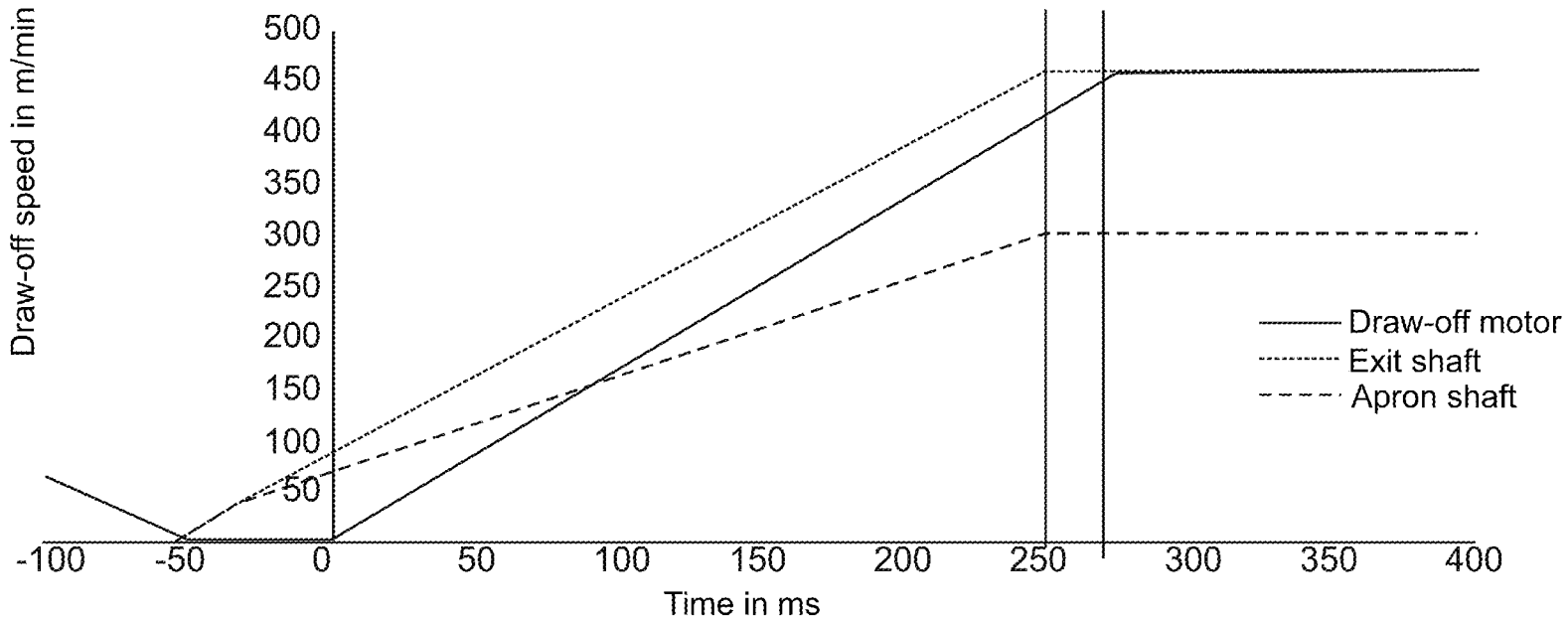
FIG. 4 shows a flowchart of the speed curve of a drafting system and a draw-off unit according to the prior art.

FIG. 4 shows a speed curve known from the prior art of an apron shaft driving the apron roller pair 48 and an exit shaft of the drafting system 4 driving the exit roller pair 26 as well as a draw-off motor driving the draw-off device 6 during the piecing process. While the draw-off device 6 is stationary, the exit shaft and the apron shaft of the draw-off roller pair 26 and the apron roller pair 48 are powered up, wherein, after a synchronous start, the apron shaft has a lower speed than the exit shaft in order to stretch the sliver 25 in the drafting system 4. The period between the start of powering up the drafting system 4 and the draw-off device 6 by starting up the draw-off motor establishes a dwell time within which the free thread end 37 is positioned in the vortex chamber 33 and is connected to the sliver 25 supplied by the drafting system 4. After the draw-off device 6 has been powered up, the draw-off speed increases linearly up to a predetermined draw-off speed which is constant during the ongoing spinning process and is referred to as the production speed. In the piecing process known from the prior art, which is shown in the diagram in FIG. 4, the speed increase of the draw-off device 6 and of the drafting system 4 is linear until the predetermined draw-off speed is reached.

Figure 5:
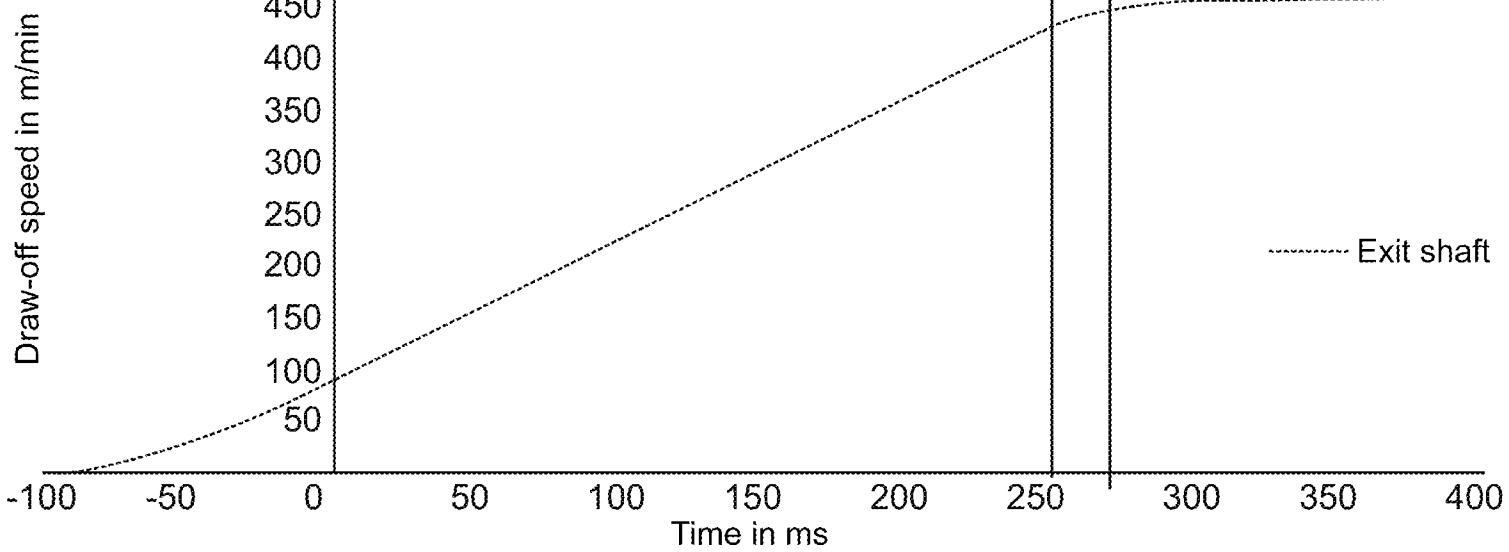
FIG. 5 shows a flowchart of the speed curve of an exit roller pair according to one exemplary embodiment of the invention.

FIG. 5 shows a diagram of the speed curve of the exit shaft driving the exit roller pair 26, which is provided according to an embodiment of the method according to the invention. Accordingly, during the piecing process, the speed of the exit roller pair 26 is non-linear, i.e. the speed curve is arcuate in portions, both at the beginning of powering up and around the end of powering up before reaching the predetermined draw-off speed. A corresponding control of the exit roller pair 26 ensures that the fibers are introduced evenly into the vortex chamber 33 and also reduces the loads.

LIST OF REFERENCE SIGNS

1 Air-jet spinning machine
2 Spinning station
3 Spinning can
4 Drafting system
5 Air-jet spinning device
6 Draw-off device
7 Thread cleaner
8 Thread traversing device
9 Take-up bobbin
13A, 13B Machine frame
14 Outer housing
15 Outer housing
16 Expansion housing
17 Nozzle block
18 Sliver guide
19 Spinning cone
20 Annular space
21 Pneumatic line
22 Overpressure source
23 Blowing air nozzle
24 Head
25 Sliver
26 Exit roller pair
28 Expansion space
29 Exhaust air channel
31 Holding/unraveling tube
32 Valve
33 Vortex chamber
34 Valve
35 Inlet opening
36 Thread
37 Thread end
38 Control unit
39 Thread take-up device
40 Thread-end preparation device
41 Pneumatic line
42 Compressed air source
43 Valve
44 Control line
45 Blowing nozzle
46 Annular space
47 Take-up housing
48 Apron roller pair
50 Cutting device
51 First drafting system roller pair
52 Second drafting system roller pair
60 Thread guide channel
62 First channel portion
62A First end
62B Second end
64 Second channel portion
64A First end
64B Second end

66 Channel connection portion
67 Thread deflection portion
68 Opening
70 Housing
72 Compressed air connection
74 Nozzle insert
76 Funnel inlet
77 Thread passage
78 Thread passage
79 Fastening screws
80 O-ring
R Thread running direction

The invention claimed is:

1. A method for carrying out a piecing process on a spinning station of an air-jet spinning machine having an air-jet spinning device, wherein:

taking up a thread end that has run onto a take-up bobbin by a thread take-up device and transferring the thread end to a thread-end preparation device downstream from a vortex chamber of the air-jet spinning device in a thread running direction;

subsequently treating the thread end in the thread-end preparation device and then transferring the thread end to the vortex chamber of the air-jet spinning device and positioned there;

powering up a drafting system for drafting and supplying a sliver to the vortex chamber, wherein an exit roller pair of the drafting system is accelerated up to a predetermined draw-off speed, and wherein the sliver is spun onto the thread end in the vortex chamber; and powering up a motor-driven draw-off device for drawing off thread spun in the vortex chamber and thereby accelerating up to a draw-off speed;

wherein the drafting system and/or the draw-off device are powered up in such a way that a speed of the exit roller pair and/or of the draw-off device approaches a predetermined draw-off speed non-linearly around an end of powering up.

2. The method according to claim 1, further including powering up a drafting system roller pair and/or an apron roller pair of the drafting system arranged upstream from the exit roller pair in the thread running direction in such a way that speeds thereof increase non-linearly at a beginning of powering up and/or approaches a respective final speed associated with the draw-off speed non-linearly around the end of powering up.

3. The method according to claim 1, wherein the exit roller pair and/or the draw-off device are powered up in such a way that speeds thereof are linear in a range between the non-linear start of powering up and/or the non-linear approach to the draw-off speed around the end of powering up.

4. The method according to claim 1, wherein the drafting system and/or the draw-off device are powered up in such a way that the speed of the exit roller pair and/or of the draw-off device increases non-linearly at a beginning of powering up.

5. A spinning station of an air-jet spinning machine for producing a thread from a sliver, the spinning station comprising:

a vortex chamber in which a twist is imparted to a sliver by an air flow to form threads;

a draw-off device for drawing off the thread formed in the vortex chamber from the vortex chamber;

a drafting system for conveying the sliver toward an inlet opening of the vortex chamber; and a thread-end preparation device for treating a thread end taken up from a take-up bobbin by a thread take-up device and transferring the thread end to the vortex chamber; and a control unit for carrying out the method for carrying out the piecing process according to claim 1.

6. The spinning station according to claim 5, wherein the control unit is designed to adjust the non-linear speed increase of the exit roller pair and/or the draw-off device at the beginning of powering up and/or at the end of powering up.

7. A method for carrying out a piecing process on a spinning station of an air-jet spinning machine having an air-jet spinning device, wherein:

taking up a thread end that has run onto a take-up bobbin by a thread take-up device and transferring the thread end to a thread-end preparation device downstream from a vortex chamber of the air-jet spinning device in a thread running direction;

subsequently treating the thread end in the thread-end preparation device and then transferring the thread end to the vortex chamber of the air-jet spinning device and positioned there;

powering up a drafting system for drafting and supplying a sliver to the vortex chamber, wherein an exit roller pair of the drafting system is accelerated up to a predetermined draw-off speed, and wherein the sliver is spun onto the thread end in the vortex chamber; and powering up a motor-driven draw-off device for drawing off thread spun in the vortex chamber and thereby accelerating up to a draw-off speed;

wherein the drafting system and/or the draw-off device are powered up in such a way that a speed of the exit roller pair and/or of the draw-off device increases non-linearly at a beginning of powering up and/or approaches a predetermined draw-off speed non-linearly around an end of powering up; and wherein, in order to establish a period defining a dwell time of the thread end in the vortex chamber, the drafting system is powered up before the draw-off device.

8. A method for carrying out a piecing process on a spinning station of an air-jet spinning machine having an air-jet spinning device, wherein:

taking up a thread end that has run onto a take-up bobbin by a thread take-up device and transferring the thread end to a thread-end preparation device downstream from a vortex chamber of the air-jet spinning device in a thread running direction;

subsequently treating the thread end in the thread-end preparation device and then transferring the thread end to the vortex chamber of the air-jet spinning device and positioned there;

powering up a drafting system for drafting and supplying a sliver to the vortex chamber, wherein an exit roller pair of the drafting system is accelerated up to a predetermined draw-off speed, and wherein the sliver is spun onto the thread end in the vortex chamber; and powering up a motor-driven draw-off device for drawing off thread spun in the vortex chamber and thereby accelerating up to a draw-off speed;

wherein the drafting system and/or the draw-off device are powered up in such a way that a speed of the exit roller pair and/or of the draw-off device increases non-linearly at a beginning of powering up and/or approaches a predetermined draw-off speed non-linearly around an end of powering up; and wherein the exit roller pair is powered up in advance of and decoupled from at least one drafting system roller pair and/or apron roller pair of the drafting system arranged upstream from the exit roller pair in the thread running direction.

9. A method for carrying out a piecing process on a spinning station of an air-jet spinning machine having an air-jet spinning device, wherein:

taking up a thread end that has run onto a take-up bobbin by a thread take-up device and transferring the thread end to a thread-end preparation device downstream from a vortex chamber of the air-jet spinning device in a thread running direction;

subsequently treating the thread end in the thread-end preparation device and then transferring the thread end to the vortex chamber of the air-jet spinning device and positioned there;

powering up a drafting system for drafting and supplying a sliver to the vortex chamber, wherein an exit roller pair of the drafting system is accelerated up to a predetermined draw-off speed, and wherein the sliver is spun onto the thread end in the vortex chamber; and powering up a motor-driven draw-off device for drawing off thread spun in the vortex chamber and thereby accelerating up to a draw-off speed;

wherein the drafting system and/or the draw-off device are powered up in such a way that a speed of the exit roller pair and/or of the draw-off device increases non-linearly at a beginning of powering up and/or approaches a predetermined draw-off speed non-linearly around an end of powering up; and wherein during a take-up of the thread end that has run onto the take-up bobbin and the transfer of the thread end to the thread-end preparation device, and/or preparation of the thread end in the thread-end preparation device, and/or transfer and positioning of the thread end in the vortex chamber, the method includes operating the exit roller pair at a predetermined combing out speed, and stopping or operating at a holding speed associated with the combing out speed at least one drafting system roller pair and/or apron roller pair upstream from the exit roller pair in the thread running direction, the holding speed being a maximum of 10% of the combing out speed.

10. A method for carrying out a piecing process on a spinning station of an air-jet spinning machine having an air-jet spinning device, wherein:

taking up a thread end that has run onto a take-up bobbin by a thread take-up device and transferring the thread end to a thread-end preparation device downstream from a vortex chamber of the air-jet spinning device in a thread running direction;

subsequently treating the thread end in the thread-end preparation device and then transferring the thread end to the vortex chamber of the air-jet spinning device and positioned there;

powering up a drafting system for drafting and supplying a sliver to the vortex chamber, wherein an exit roller pair of the drafting system is accelerated up to a predetermined draw-off speed, and wherein the sliver is spun onto the thread end in the vortex chamber; and powering up a motor-driven draw-off device for drawing off thread spun in the vortex chamber and thereby accelerating up to a draw-off speed;

wherein the drafting system and/or the draw-off device are powered up in such a way that a speed of the exit roller pair and/or of the draw-off device increases non-linearly at a beginning of powering up and/or approaches a predetermined draw-off speed non-linearly around an end of powering up; and wherein the drafting system has a single-motor driven draw-off roller pair which can be controlled decoupled from additional drafting system roller pairs and/or apron roller pairs by a control unit.

* * * * *